US006356199B1

(12) United States Patent
Niziolek et al.

(10) Patent No.: US 6,356,199 B1
(45) Date of Patent: Mar. 12, 2002

(54) DIAGNOSTIC IONIC FLAME MONITOR

(75) Inventors: James M. Niziolek, Enfield; William M. Clark, Windsor; James M. Bialobrzeski, Suffield; Terry M. Grayson, Granby, all of CT (US)

(73) Assignees: ABB Inc., Norwalk, CT (US); ABB Automation Inc., Wickliffe, OH (US)

( * ) Notice: Subject to any disclaimer, the term of this patent is extended or adjusted under 35 U.S.C. 154(b) by 0 days.

(21) Appl. No.: 09/703,118

(22) Filed: Oct. 31, 2000

(51) Int. Cl.[7] ..... G08B 17/12

(52) U.S. Cl. ..... 340/579; 340/577; 340/578; 431/12; 431/75; 431/76

(58) Field of Search ..... 340/579, 577, 340/578; 431/75, 76, 78, 84, 12, 25; 250/554

(56) References Cited

U.S. PATENT DOCUMENTS 3,740,574 A * 6/1973 Taylor ..... 307/117
4,107,657 A * 8/1978 Nishigaki et al. ..... 340/579
4,370,557 A * 1/1983 Axmark et al. ..... 250/554
5,073,104 A * 12/1991 Kemlo ..... 431/12
5,472,337 A * 12/1995 Guerra ..... 431/78
5,952,930 A * 9/1999 Umeda et al. ..... 340/579

* cited by examiner

*Primary Examiner*—Daniel J. Wu
*Assistant Examiner*—Toan Pham
(74) *Attorney, Agent, or Firm*—Michael M. Rickin

(57) ABSTRACT

An ionic flame monitor. The flame monitor has a flame rod that produces an ionization current when the flame rod is immersed in a flame and excited by a voltage. The ionization current has a DC component and an AC component each dependent on the intensity of the flame, and a flicker frequency. The flame monitor also has a computing device that is responsive to signals representative of the flicker frequency, and the AC and DC components of the ionization current for determining the existence of the flame.

31 Claims, 5 Drawing Sheets

IONIZATION CURRENT FROM 1FM ROD IN IGNITOR FLAME

IONIZATION CURRENT FROM 1FM ROD IN IGNITOR FLAME

DIAGNOSTIC IONIC FLAME MONITOR

FIELD OF THE INVENTION

This invention relates to ionic flame monitors and more particularly to such a monitor that detects all of the characteristic components of the ionization current resulting from a flame.

DESCRIPTION OF THE PRIOR ART

Ionic flame monitoring (IFM) is a time proven method of detecting the presence of flame in fossil fuel combustion system. This particular technique for flame monitoring is primarily used for determining the existence of flame in oil and/or gas fired ignition system in industrial, utility, and commercial boilers.

The ignition system is commonly referred to as an ignitor or lighter.

One example of the use of ionic flame monitoring is described in U.S. Pat. No. 4,588,372 wherein a flame rod is used to monitor the flame in a gas burning furnace to maintain a peak flame rod current. This results in incomplete combustion due to a shortage of primary air. The furnace in that patent includes a secondary air inlet that is sized to maintain excess air in the combustion chamber for complete combustion.

During the combustion of hydrocarbon fuels, free ions and charged particles are produced making the hydrocarbon-fuel flame electrically conductive. Another combustion characteristic of a hydrocarbon-fuel flame is that it pulsates resulting in time varying numbers of free electrons and charged particles. Thus the conductivity of the hydrocarbon-fuel flame will also pulsate.

As is shown in FIG. 1 when a DC excitation voltage is applied to an electrode 10, called an IFM rod, immersed in the hydrocarbon-fuel flame 12 an ionization current 20 is produced. The ionization current 20 has as is shown in FIG. 2 a DC component 22 that is produced by a minimum number of free electrons and charged particles always being present in the flame.

The ionization current also has an AC component 24 that is the result of the changes in conductivity produced by the flame pulsation, and a flicker frequency 26, also known as the pulsation frequency, arising from the pulsation of the flame. The DC intensity 22, AC intensity 24, and flicker frequency 26 of the ionization current 20 changes with the stability and quality of the hydrocarbon-fuel flame.

Existing ionic flame monitoring electronic packages typically measure one or more of these three characteristic components to determine if the fuel on an ignition system is burning. If flame is present a flame relay is energized and if there is no flame the relay is de-energized. The flame relay contact(s) are typically input into some form of combustion safety control system.

Ignition systems are problematic pieces of equipment subject to a number of operational problems. Historically ionic flame monitoring equipment only provides a flame relay contact output indicting flame does or does not exist. Typically, the electronic hardware cannot be adjusted and does not provide any feedback to the operators about the quality of the flame or operational condition of the firing equipment. Thus, existing ionic flame monitoring electronics are simply flame switches and nothing more.

It is a well established fact in the combustion industry that there is a relationship between the quality of flame and the ionization current in an ionic flame monitoring system. As the mixture of fuel and air comes closer to stoichometric conditions, the number of ions and free electrons increases thereby making the flame more conductive. For years boiler service engineers have used voltmeters to monitor the power supply voltage on an IFM rod and use the drop in voltage as an indicator that a good flame exists. Ionic flame monitoring is even used in analytical instruments to measure gas quality and fuel/air ratio.

The ionic flame monitor of the present invention measures all three ionization current parameters and presents these values in real time to operating and service personnel. The information is presented to the operator through a digital display as well as through a digital output port. The measurement of all three parameters and the presenting of information in real time to operators about those parameters allows the operator to track changes in the three parameters and thereby obtain an early warning that a problem is developing in the ignitor. Further the direction of the changes can be an indicator of a specific problem. Existing ionic flame monitors only use one or two of these parameters and may not display them in real time.

SUMMARY OF THE INVENTION

An ionic flame monitor. The flame monitor has a flame rod that produces an ionization current when the flame rod is immersed in a flame and excited by a voltage. The ionization current has a DC component and an AC component each dependent on the intensity of the flame, and a flicker frequency.

The flame monitor also has a computing device that has at least first, second and third inputs. The flame monitor further has a first circuit connected to the first input of the computing device, the first circuit responsive to the ionization current for producing at the first input an AC signal representative of the flicker frequency; a second circuit connected to the second input of the computing device, the second circuit responsive to the ionization current for producing at the second input a signal having an amplitude proportional to the ionization current AC component; and a third circuit connected to the third input of the computing device, the third circuit responsive to the ionization current for producing at the third input a signal which is related to the ionization current DC component. The computing device is responsive to the signals at the first, second and third computing device inputs for determining the existence of the flame.

DESCRIPTION OF THE PREFERRED EMBODIMENT(S)

Figure 1:
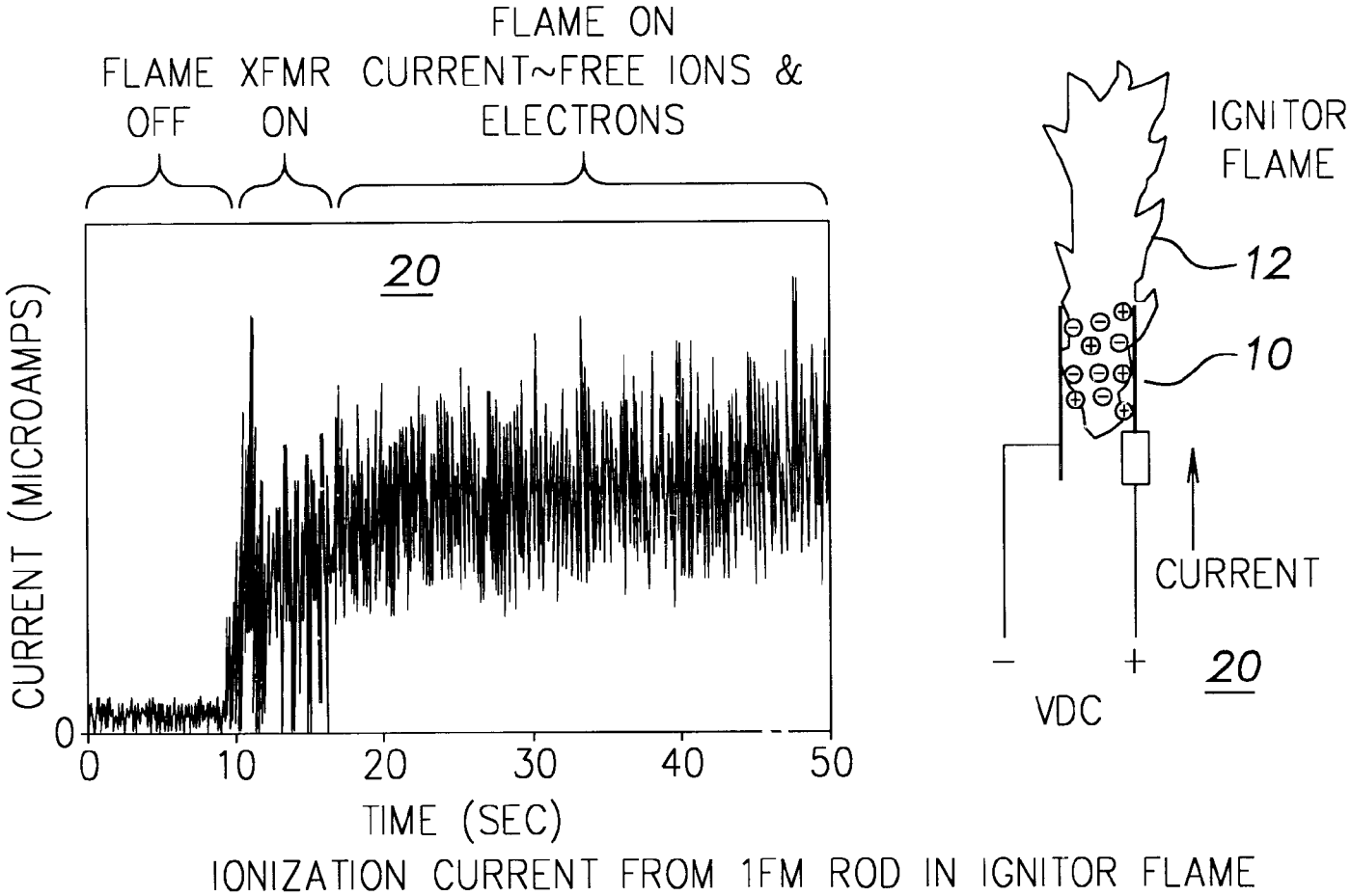
FIG. 1 shows a flame rod immersed in a flame and the ionization current produced therefrom in response to an excitation voltage.
Figure 2:
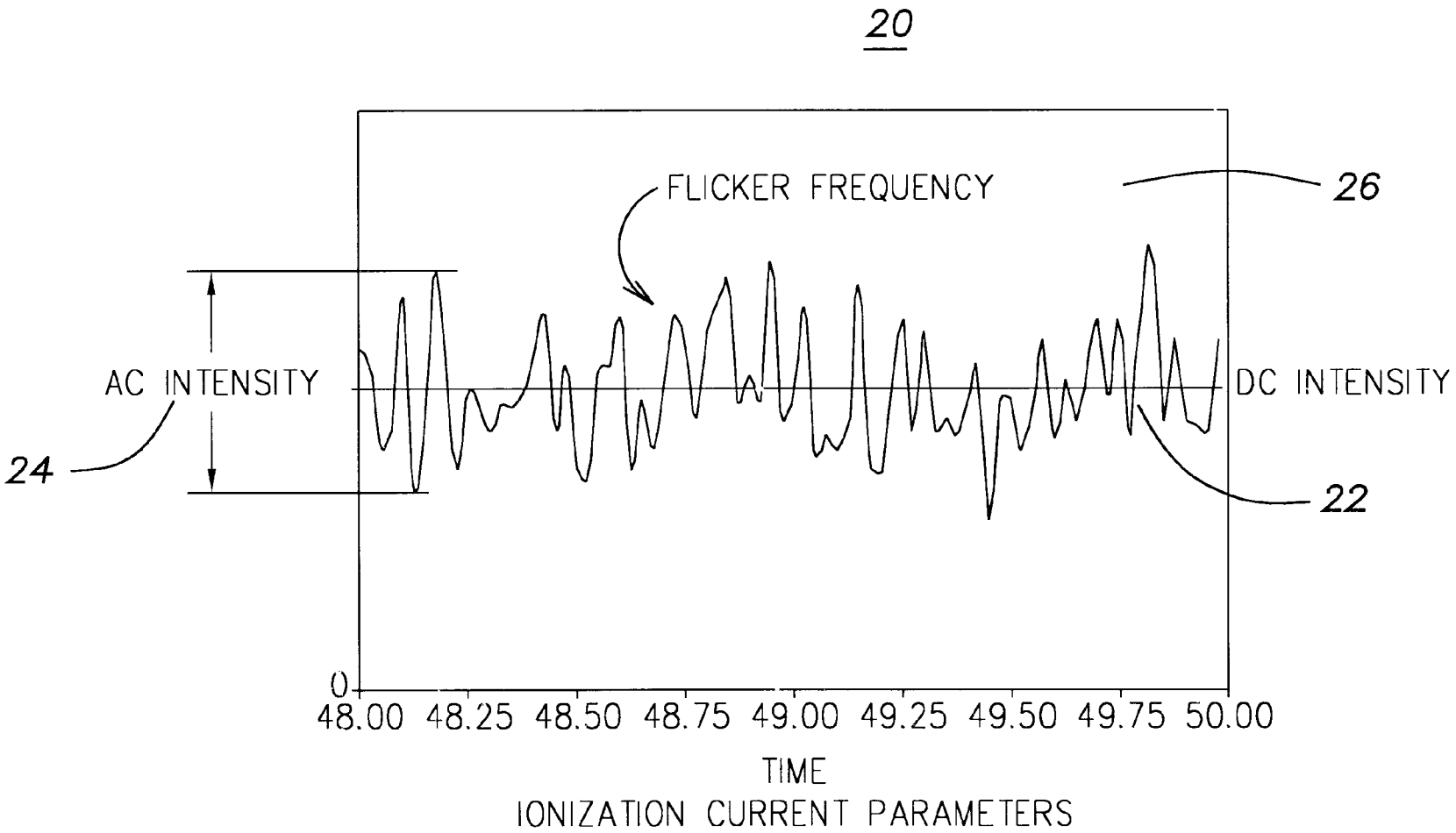
FIG. 2 shows the DC and AC intensity and flicker frequency components of the ionization current.
Figure 3:
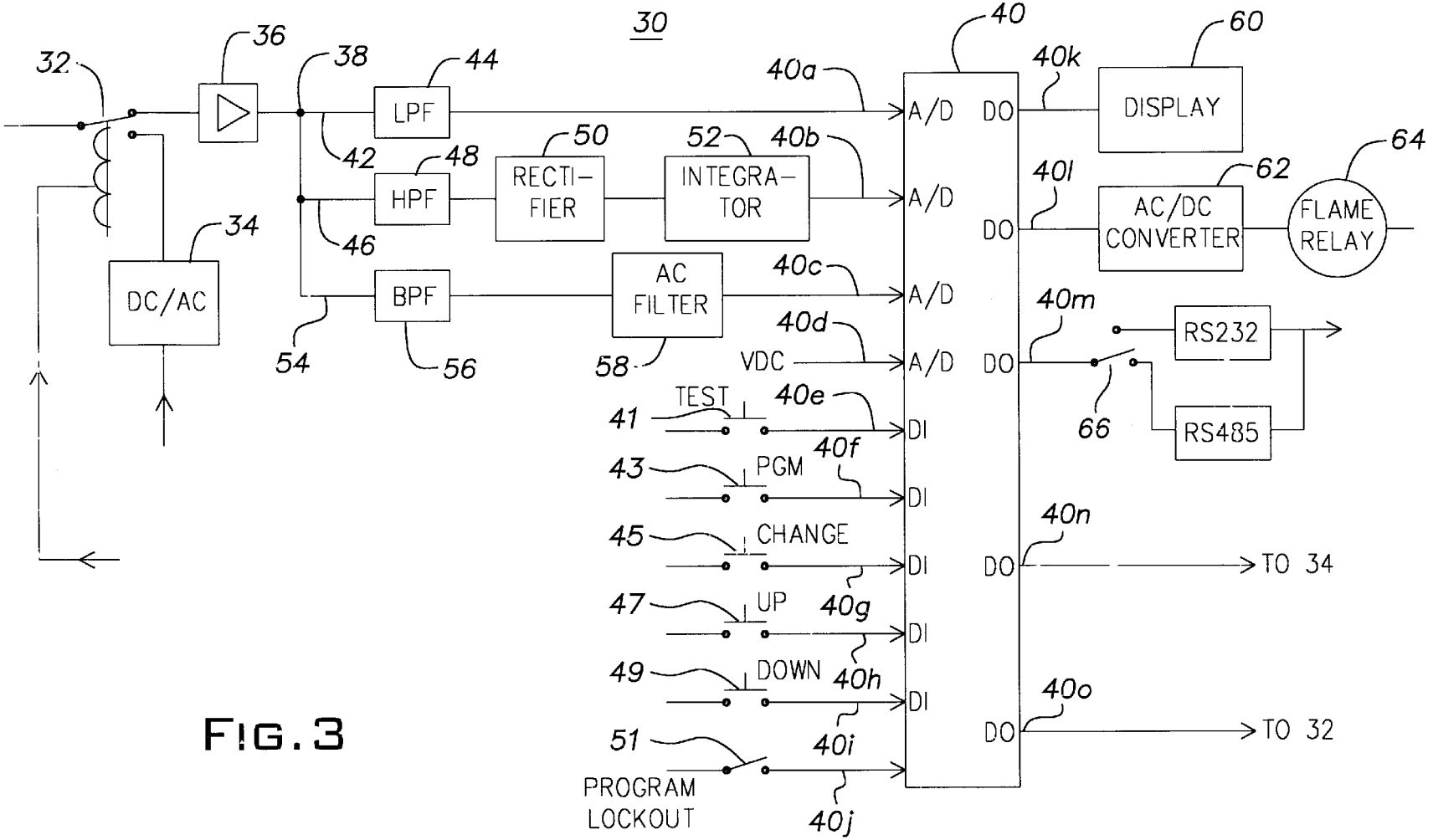
FIG. 3 shows the diagram of the circuit in the ionic flame monitor of the present invention that receives the output of the flame rod of FIG. 1.

Referring now to FIG. 3, there is shown a diagram of the circuit 30 in the ionic flame monitor of the present invention that receives the output signal from the flame rod 10 of FIG. 1. As is shown in FIG. 3, the flame rod output signal enters circuit 30 through a relay 32 controlled by a microprocessor 40. In one state the relay 32 connects the flame rod output signal to circuit 30 and in the other state the relay 32 connects a test signal 34, to be described in more detail below, to circuit 30. The flame rod output signal passes through an amplifier 36 to a junction 38. Amplifier 36 has a gain which in the present embodiment for circuit 30 is manually adjustable in four steps in the normal mode of operation of the circuit 30 and under control of microprocessor 40 in a test mode of operation of circuit 30.

The signal at junction 38 enters a first path 42 which includes a low pass filter 44 between junction 38 and input 40*c* of microprocessor 40. The low pass filter 44 provides at the input 40*c* of microprocessor 40 a DC signal which is representative of the DC intensity of the flame in which rod 10 is immersed. In one embodiment for circuit 30, low pass filter 44 had a cutoff upper frequency of 1 Hz.

The signal at junction 38 also enters a second path which includes between junction 38 and input 40*b*of microprocessor 40 the series combination of a high pass filter 48, a rectifier 50 and an integrator 52. The series combination of filter 48, rectifier 50 and integrator 52 provide at the input 40*b*of microprocessor 40 a DC voltage level that is proportional to the AC intensity of the flame in which rod 10 is immersed. In one embodiment for circuit 30, high pass filter 48 had a lower cutoff frequency of 5 Hz.

The signal at junction 38 also enters a third path 54 which includes between junction 38 and input 40*a* of microprocessor 40 the series combination of a bandpass filter 56 followed by a DC injection circuit 58. The series combination of filter 56 and DC injection circuit 58 provides at the input 40*a* of microprocessor 40 an AC signal which is the AC component of the signal from flame rod 10. In one embodiment for circuit 30, bandpass filter 56 had a passband of 13 Hz to 800 Hz with a DC injection of 2.5 VDC. It should be appreciated that the DC injection makes the AC signal all positive so that it can be inputted to the A/D converter included in microprocessor 40 as the A/D converter in one embodiment for circuit 30 had a 0–5 VDC range.

The signals at inputs 40*a,* 40*b*and 40*c* of microprocessor 40 are analog signals. In addition the microprocessor 40 also has an analog signal at input 40*d* whereby it monitors one of the voltages in the power supply included in circuit 30.

In addition to analog input signals the microprocessor 40 has the following digital input signals:

at input 40*e* from the Push to Test pushbutton 41—this input signal is used by the microprocessor to control 32;

at inputs 40*f,* 40*g,* 40*h* and 40*i* the signals arising from the operation of the four switches 43, 45, 47, 49 named Program, Change, Up and Down, respectively, which are associated with the display 60 in circuit 30—the Program switch 43 when activated provides a signal at input 43 that the user desires to program circuit 30 and the Change, Up and Down switches 45, 47, 49 when activated allow the user to change the value of certain parameters such as setpoints; and at input 40*j* from the Program Lockout slide switch 51—when activated the signal from this slide switch causes the microprocessor 40 to lock out programming of the circuit 30 by the user.

Microprocessor 40 also includes digital outputs 40*k*, 40*l*, 40*m,* 40*n* and 40*o*. The digital signal at output 40*k* is used to drive display 60. The digital signal at output 40*l* is the drive for the flame relay 64. The drive signal at output 401 is a pulse train which as is shown in FIG. 3 passes through an AC to DC converter 62 before reaching flame relay 64. The AC to DC converter 62 provides a failsafe mechanism for operation of flame relay 64 since if the microprocessor were to become non-operational the 30 signal at output 40*l* would be either a high or low level but not the pulse train that converter 62 must see in order to provide the drive signal for relay 64.

The digital signal at output 40m is a serial signal which is either in a format compatible with the RS-232 or RS-485 transmission standards and selector switch 66 is used to pass the signal to the proper path. The signal at output 40*n* is the input signal to test signal 34. The signal at output 40*o* is the signal to drive the test relay 32.

Figure 4:
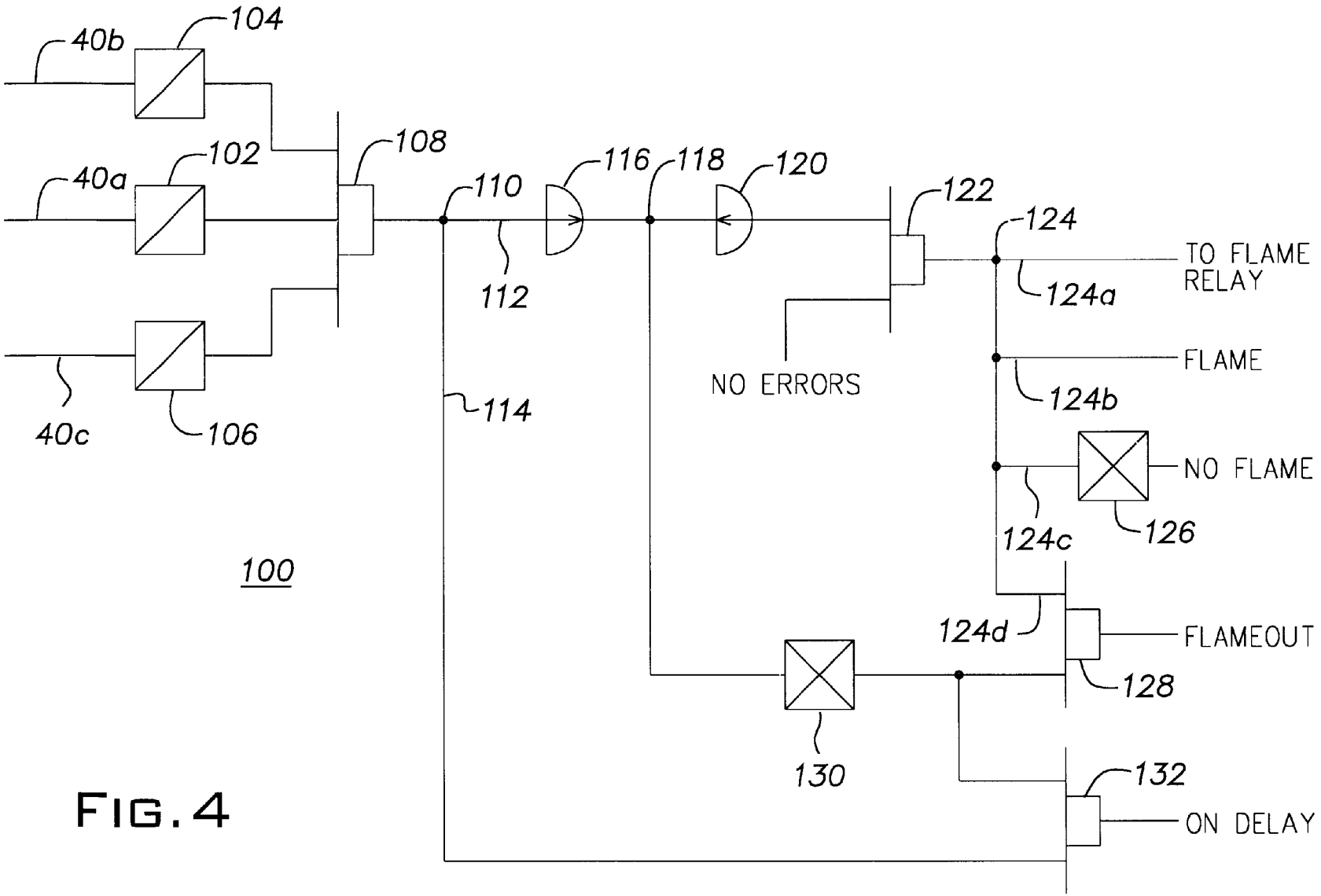
FIG. 4 shows the flame logic which responds to the analog inputs to the microprocessor in the circuit of FIG. 3 to produce the messages on the display of FIG. 3 and the operation of the flame relay in the circuit of FIG. 3.

Referring now to FIG. 4, there is shown the flame logic 100 which responds to the analog signals at inputs 40*a,* 40*b*and 40*c* of the microprocessor 40 to provide various messages on display 60 and operation of the flame relay 64 as will be described in more detail below. It should be appreciated that the logic 100 shown in FIG. 4 is the result of the execution by microprocessor 40 of program code and that those of ordinary skill in the art can as a result of the explanation to be given below be able to write suitable program code to perform these functions.

As was described above the flame monitor of the present invention measures the DC and AC components of the ionization current 20 produced by the result of a flame 12 and the flicker frequency of the flame 12. The AC signal at input 40*a* which is representative of the flicker frequency, the DC voltage level at input 40*b*that is proportional to the AC intensity of the flame 12, and the DC signal at input 40*c* which is the DC component of the signal from flame rod 10 are input to an associated comparator 102, 104, 106 respectively.

The comparators 102, 104, 106 compare the signal level at their input to an associated user adjustable setpoint. The user adjusts the setpoint of each comparator using the TEST, PROGRAM, UP and DOWN pushbuttons 43, 45, 47 and 49, and display 60. The output of each of the comparators 102, 104 and 106 is connected to an associated input of three input AND gate 108. The output of gate 108 goes high when each of the three inputs to the gate exceed their associated user programmed setpoints.

The output of the AND gate is connected to a junction 110 where the high or low level at the gate 108 output either takes a first path 112 or a second path 114. First path 112 includes a first user programmable time delay on pickup 116. Delay 116 starts to time out when the output of gate 108 goes high, that is, when all three of the measured ionization current 20 parameters have exceeded their associated setpoint. Delay 116 is needed on some ignitor control systems to allow a fuel block valve closed limit switch to clear before ignitor flame is proven. If any one of the three inputs to gate 108 falls below its associated setpoint before delay 116 times out, the timer associated with delay 116 is reset to zero. In one embodiment for circuit 30 the user can program delay 116 from 0 to 10 seconds.

The output of delay 116 is connected to a junction 118 and a second user programmable time delay 120 known as the time delay on dropout whose function will be described below. After passing through delay 120 the level from AND gate 108 reaches a two input second AND gate 122. The other input to gate 122 is a signal named "No Errors" the function of which will be explained below.

As was described above in connection with FIG. 3, the microprocessor 40 monitors at input 40*d* one of the voltages generated by the power supply in circuit 30. The microprocessor also monitors various other conditions associated with circuit 30 such as the input from a watchdog timer circuit and the condition of the A/D converter included in microprocessor 40. These inputs to microprocessor 40 are not shown in FIG. 3. This monitoring by the microprocessor 40 occurs at predetermined intervals of time and in one embodiment for circuit 30 was set to occur at ten (10) times per second for each of the monitored conditions. The microprocessor 40 considers the occurrence of any one of the monitored conditions to be an error and thus the "No Errors" signal, which appears at one of the inputs to AND gate 120, is an indication by the microprocessor 40 that none of the monitored conditions have occurred.

The output of gate 122 is connected to a junction 124 which is connected to a first path 124*a* to thereby provide a signal to the flame relay 64. When all three of the measured parameters of ionization current 20 exceed their associated setpoint, the output of gate 108 goes high. If the output of gate 108 remains high the delay 116 times out and the output of delay 116 goes high at the end of that delay time. The going high of the output of delay 116 appears at the input to delay 120 and the output of delay 120 immediately goes high, that is, delay 120 does not delay the appearance at its output of a change from a low to a high level at its input.

If the No Errors signal is present at gate 122, the output of gate 122 goes high when the output of delay 120 goes high and this energizes the flame relay 64. Therefore the flame relay 64 is energized when all three of the measured parameters of the ionization current 20 simultaneously exceed their associated setpoint for the time associated with delay 116.

The junction 124 is also connected to a path 124*b* which is directly connected to display 60. If the output of AND gate 122 is a high level the display 60 shows, as a result of path 124*b*, the message "FLAME." This message tells the user of the flame monitor of the present invention that the flame monitor has proven the presence of a hydrocarbon fuel flame 12 since all three measured parameters of the ionization current 20 have simultaneously exceeded their programmed setpoint at comparators 102, 104, 106 for the time associated with delay 116, and the flame relay 64 is energized.

The junction 124 is further connected to a path 124*c* which is connected by an inverter 126 to display 60. If one or more of three measured parameters of the ionization current 20 has not exceeded its programmed setpoint at the associated one of comparators 102, 104, 106 then the output of AND gate 108 remains low as does the output of AND gate 122 remain even though microprocessor 40 has not detected any errors and the flame relay 64 is deenergized. Since in this circumstance the output of AND gate 122 is a low level the display 60 shows, as a result of path 124*c* and inverter 126, the message "NO FLAME." Thus when flame relay 64 is deenergized and all three of the measured parameters of the ionization current 20 have not each simultaneously exceeded their associated setpoints the display 60 shows the "NO FLAME" message.

As was described above, when the three measured parameters of the ionization current 20 have each simultaneously exceeded their associated programmed setpoint signals and the delay 116 has timed out and there are not any errors detected by microprocessor 40 the flame relay 64 is energized. If one or more of the three measured parameters should thereafter fall below its associated setpoint, the output of gate 108 immediately goes low. The flame relay 64 is, however, not immediately deenergized because of the time delay in dropout 120 which prevents the change from a high to a low level at gate 108 from appearing at the output of gate 122 until delay 120 times out. The timer of delay 120 is reset to zero if the output of gate 108 returns to a high level before delay 120 times out. The time delay on dropout 120 eliminates nuisance trips of the ignitor when short duration perturbations occur in the ignitor flame. In one embodiment of circuit 30, delay 120 was programmable from 0 to 2.0 seconds.

The output of gate 122 at junction 124 is also connected by path 124d to one input of a two input AND gate 128. The other input to gate 128 is connected by an inverter 130 to junction 118. When the output of AND gate 108 has changed from a high level to a low level as a result of one or more of the three measured parameters falling below its associated setpoint and delay 120 is not yet timed out, the output of AND gate 128 is at a high level and the display 60 shows the message "FLAMEOUT." Therefore the appearance of "FLAMEOUT" on display 60 indicates to the user that the flame monitor of the present invention has lost proven flame and is in the time delay cycle where the "FLAME" display may be restored as the flame relay 64 is still energized.

As was described above, when all three of the measured parameters of the flame 12 have each simultaneously exceeded their associated setpoint, the output level at AND gate 108 becomes a high level. The appearance of that high level at gate 122 is delayed by the programmable delay of time delay on pickup 116. During the timing out of this delay the display 60 should provide a message to the user that delay 116 has not yet timed out. The appearance of "ON DELAY" in display 60 is that message. As is shown in FIG. 4, the output of AND gate 108 is connected to one input of a two input AND gate 132. The other input to gate 132 is connected by inverter 130 to junction 118 which is at a low level when delay 116 has not yet timed out. Thus, when delay 116 is timing out the output of gate 132 provides the high level that causes display 60 to show the "ON DELAY" message.

Figure 5:
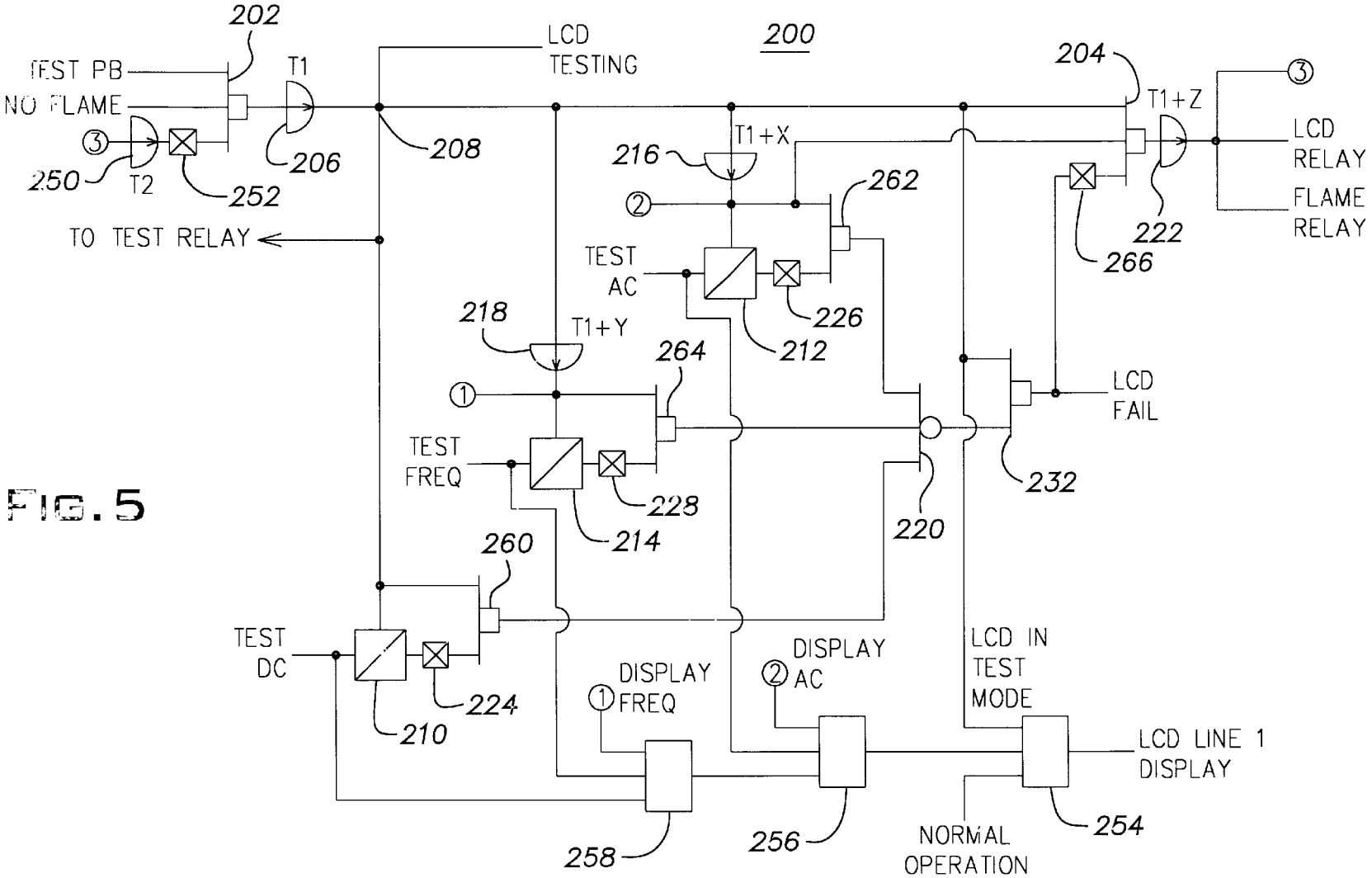
FIG. 5 shows the self test logic in the circuit of FIG. 3.

The flame monitor of the present invention further includes as part of circuit 30 the logic shown on FIG. 5 to allow the user to self test the flame monitor. It should be appreciated that the logic 200 shown in FIG. 5 is the result of the execution by microprocessor 40 of program code and that those of ordinary skill in the art can as a result of the explanation to be given below be able to write suitable program code to perform these functions.

The self test logic 200 is initiated only when the user presses the TEST pushbutton 41 shown in FIG. 3 for a predetermined period of time and the flame monitor has not proven a flame, that is, display 60 shows the message "NO FLAME." These two signals are two of the input signals to three input AND gate 202.

The output of AND Gate 204 when high indicates that the self test was successful. The high out of gate 204 passes through a delay 222 having a time T1+Z, where Z as is described below is the time in seconds to complete all three parts of the self test and T1 is the time associated with first delay 206, then through a delay 250 having a time T2 and finally through an inverter 252 to the third input of AND gate 202. Therefore, a new self test will not be initiated after the successful completion of a previous self test until the Time T2 of delay 252 times out.

The output of gate 202 is connected through first delay 206 to a junction 208. Delay 206 delays the high level which has appeared at the output of gate 202 from appearing at junction 208 for the predetermined time T1. The predetermined time T1 requires that the user hold the TEST pushbutton 41 depressed for at least that period of time before the self test procedure is initiated. If the user releases the TEST pushbutton 41 at any time before the self test is completed the self testing is terminated. If the user holds the TEST pushbutton depressed for time T1, the high level at the output of gate 202 appears at junction 208 and a suitable message appears on one line of the display 60 to inform the user that circuit 30 has entered the self test mode. In one embodiment for the flame monitor of the present invention the display 60 has two lines of display and the message that appears on line 2 of the display to indicate that circuit 30 is in the self test mode is "#TESTING", and the predetermined delay time T1 of delay 206 was set at five (5) seconds.

When the time T1 of delay 206 times out, the high level at junction 208 causes the test relay 32 to be energized and the flame rod 10 to be disconnected from the flame monitor and the gain of amplifier 36 to be temporarily reset to a known setting. As is shown on FIG. 3, the microprocessor provides at output 40*o* the signal to energize the flame relay 32.

As was described in connection with FIG. 3, an AC/DC test signal 34 is input to circuit 30 when the flame monitor is in the self test mode of operation. As is shown in FIG. 3, the microprocessor provides at output 40*n* the AC/DC test signal.

Junction 208 is connected to a first comparator 210 which compares the DC test signal which is representative of the DC intensity that would be received from a flame rod 10 to fixed upper and lower limits that represent the acceptable minimum and maximum values for the DC intensity.

Junction 208 is also connected through a delay 216 to a second comparator 212 which compares the AC test signal which is representative of the AC intensity that would be received from a flame rod 10 to fixed upper and lower limits that represent the acceptable minimum and maximum values for the AC intensity. The signal at junction 208 is delayed from appearing at the input to comparator 212 for the predetermined time T1+X of delay 216. In one embodiment for the flame scanner of the present invention, the predetermined time X of delay 216 was set at five (5) seconds.

Junction 208 is further connected through a delay 218 to a second comparator 214 which compares the flicker frequency test signal to fixed upper and lower limits that the acceptable minimum and maximum values for the flicker frequency. The signal at junction 208 is delayed from appearing at the input of comparator 214 for the predetermined time T1+Y of delay 218. In one embodiment for the flame scanner of the present invention, the predetermined time Y of delay 218 was set at ten (10) seconds.

During each of the three parts of the self test an appropriate message appears in the display to inform the user about that part of the test. In the one embodiment for circuit 30 where display 60 has two lines that message appears in line one.

The logic 200 includes selectors 254, 256 and 258 each of which have three inputs, 254*a–c*, 256*a–c* and 258*a–c*. Input 254*a*, 256*a* and 258*a* are the control input to each selector. The level of the control input of each selector 254, 256, 258 determines if the output of the selector is either the input 254*b*, 256*b*, 258*b* or the input 254*c*, 256*c*, 258*c*. When the level of the control input is low the output of each selector is the associated input 254*c*, 256*c*, 258*c* and when the level of the control input is high the output of each selector is the associated input 254*b*, 256*b*, 258*b*.

Control input 254*a* of selector 254 is connected to junction 208. Input 254*b* is connected to the output of selector 256. Input 254*c* is connected to a signal named "NORMAL OPERATION." When circuit 30 is not in the self test mode of operation the signal at junction 208 is at a low level and the output of selector 254 is the NORMAL OPERATION signal which allows line one of the display 60 to display the messages associated with the normal operation of circuit 30. When circuit 30 is in the self test mode of operation the signal at junction 208 is at a high level and selector 254 provides to line one of display 60 the message that appears at input 254*b* from selectors 256 and 258.

The control input 256*a* of selector 256 is connected to the output of delay 216. The input 256*b* is connected to the TEST AC input of comparator 212. The input 256*c* is connected to the output of selector 258. When circuit is in the test mode and the output of timer 216 is low, the display 60 displays in line one the message that is at the output of selector 258. When circuit 30 is in the test mode and the output of delay 216 is high, line one of display 60 displays the AC value.

The control input 258*a* of selector 258 is connected to the output of delay 218. The input 256*b* is connected to the TEST FREQ input of comparator 214. The input 256*c* is connected to the TEST DC input of comparator 210. When circuit 30 is in the test mode and the timer 218 has not timed out, the output of selector 258 is the DC intensity. When circuit 30 is in the test mode and output of delay 218 has timed out, the output of selector 258 is the FREQ value.

Therefore, when circuit 30 is in the test mode the following displays appear in line one of display 60:

a) during the time from T1 to T1+X, the DC intensity;

b) during the time from T1+X to T1+Y, the AC intensity; and c) during the time from T1+Y until the signal level at junction 208 next goes low, the FREQ value.

The output of each of comparators 210, 212, 214 is connected through an associated inverter 224, 226, 228, respectively to one of the two inputs of an associated two input AND gate 260, 262, 264, respectively. When the DC intensity, the AC intensity and the flicker frequency are each during their test within their associated upper and lower limits, the output of each of gates 260, 262, 264 is a low.

The other input of gates 260, 262, 264 is connected to the input of the associated comparator 210, 212, 214 that receives the signal level at junction 208. When one of the parameters, DC intensity, Ac intensity, flicker frequency is undergoing its test the signal level at this other input of the associated gate 260, 262, 264 is a high level. When a parameter is not undergoing its test the signal level at this other input of the associate gate 260, 262, 264 is a low level. Thus when a parameter, for example, DC intensity is undergoing its test, the output of the associated gate, which is 260 for the DC intensity test, is a high level only if the parameter does not pass its test and is a low level at all other times during the self test mode of operation of circuit 30.

The gates 260, 262, 264 are each connected to an associated input of three input OR gate 220. Since the output of gates 260, 262, 264 are all a low level during the self test mode of operation unless the associated parameter does not pass its test, the output of OR gate 220 is a low level if during the self mode of operation each of three parameters passes its associated test and is a high level only if one or more of the parameters does not pass its test.

The output of OR gate 220 is connected to one input of two input AND gate 232. The other input to AND gate 232 is the signal level at junction 208. The output of gate 232 when a high level allows the display 60 to show the message "#FAIL" in line two when display 60 is embodied as the two line display. Since the input of gate 232 connected to the output of OR gate 220 is only a high level if one or more of the tested parameters has not passed its associated test, the message "#FAIL" only appears in the display 60 if one or more of the tested parameters has not passed its test. Upon seeing this message the user of the flame monitor should release the Test pushbutton 41.

The output of gate 232 is connected by an inverter 266 to one of the three inputs of AND gate 204. Since the output of AND gate 232 during the self test mode of operation is only a high level if one or more of the tested parameters does not pass its associated test, the output of gate 204 is always a high level unless one of more of the three parameters does not pass its associated test.

The appearance of a high level at the output of gate 204 is connected to a delay 222 which has a delay time equal to the time of delay 206 plus a predetermined amount of time Z. Once delay 222 times out the high level at its input appears at its output and the flame relay 64 is momentarily energized and the display 60 shows the message "#RELAY" to tell the user that the self test was successfully completed. The high level at the output of delay 222 is connected by an inverter to one input of three input AND gate 202 to clear the self testing logic. In the one embodiment for the flame monitor of the present invention where the time of delay 206 is five seconds the predetermined amount of time Z for delay 222 was set at fifteen seconds.

It is to be understood that the description of the preferred embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. An ionic flame monitor comprising:

a. a flame rod that produces an ionization current when the flame rod is immersed in a flame and excited by a voltage, said ionization current having a DC component and an AC component each dependent on the intensity of said flame, and a flicker frequency;

b. a computing device having at least first, second and third inputs;

c. a first circuit connected to said first input of said computing device, said first circuit responsive to said ionization current for producing at said first input an AC signal representative of said flicker frequency;

d. a second circuit connected to said second input of said computing device, said second circuit responsive to said ionization current for producing at said second input a signal having an amplitude proportional to said ionization current AC component; and e. a third circuit connected to said third input of said computing device, said third circuit responsive to said ionization current for producing at said third input a signal which is related to said ionization current DC component;

said computing device responsive to said signals at said first, second and third computing device inputs for determining the existence of said flame.

2. The flame monitor of claim 1 wherein said computing device has a setpoint associated with each of said signals at said first, second and third inputs and said computing device proves the existence of a flame when all three of said signals each exceed said associated setpoint.

3. The flame monitor of claim 1 further comprising a display.

4. The flame monitor of claim 3 wherein said computing device has a setpoint associated with each of said signals at said first, second and third inputs and said computing device sends to said display a message that said flame exists when all three of said signals each exceed said associated setpoint.

5. The flame monitor of claim 1 wherein said computing device has a setpoint associated with each of said signals at said first, second and third inputs and a first delay associated with a falling below of any one or more of said three of said signals fall below said associated setpoint after all three of said signals have simultaneously each exceeded said associated setpoint.

6. The flame monitor of claim 5 wherein said first delay is activated when at least one of said three signals falls below said associated setpoint after all three of said signals have simultaneously each exceeded said associated setpoint.

7. The flame monitor of claim 6 further comprising a display.

8. The flame monitor of claim 7 wherein said computing device sends to said display an appropriate message when said first delay is timing out.

9. The flame monitor of claim 6 wherein said computing device determines that there is not any flame when said first delay times out and at least one of said one or more of said signals that fell below said associated setpoint did not exceed said associated setpoint at any time during said activation of said first delay.

10. The flame monitor of claim 1 wherein said computing device has a setpoint associated with each of said signals at said first, second and third inputs and a second delay associated with all three of said signals simultaneously exceeding said associated setpoint.

11. The flame monitor of claim 10 wherein said second delay is activated when all three of said signals first simultaneously exceed said associated setpoint.

12. The flame monitor of claim 11 wherein said second delay times out when all three of said signals simultaneously exceeds said associated setpoint for the period of said second delay.

13. The flame monitor of claim 11 further comprising a display.

14. The flame monitor of claim 12 wherein said computing device sends to said display an appropriate message when said second delay times out.

15. The ionic flame monitor of claim 1 wherein said ionic flame monitor further comprises an input for receiving said ionization current and an amplifier having a gain adjustable in a predetermined number of steps between said input and said first, second and third circuits.

16. The ionic flame monitor of claim 15 wherein said gain of said amplifier is manually adjustable.

17. The ionic flame monitor of claim 15 wherein said gain of said amplifier is adjustable under control of said computing device.

18. The ionic flame monitor of claim 1 further comprising means connected to said computing device which when activated disconnects said ionization current from said computing device and provides a test signal representative of an ionization current internal to said flame monitor to said computing device for testing said flame monitor.

19. The ionic flame monitor of claim 18 wherein said means for providing said internal test signal comprises a switch which when activated disconnects said ionization current from said computing device and connects said test signal to said computing device.

20. The ionic flame monitor of claim 19 further comprising a test signal source connected to said means for providing said internal test signal.

21. The ionic flame monitor of claim 18 said means for providing said internal test signal includes a predetermined time delay which must elapse from initiation of an internal test of said flame monitor before said test signal is applied to said computing device.

22. The ionic flame monitor of claim 18 further comprising a display connected to said computing device for displaying the results of said internal test of said flame monitor.

23. The ionic flame monitor of claim 18 wherein said internal test is performed in a predetermined sequence of steps to test the response of flame monitor to said internal signal representative of an ionization current.

24. The ionic flame monitor of claim 23 wherein said predetermined sequence of steps for said internal test first tests said flame monitor for responsiveness to the DC intensity of said internal signal representative of an ionization current.

25. The ionic flame monitor of claim 18 wherein said internal test tests the response of said flame monitor for responsiveness to the DC intensity, AC intensity and flicker frequency of said internal signal representative of said ionization current.

26. The ionic flame monitor of claim 25 further comprising a display connected to said computing device for displaying the results of said internal test of said flame monitor, said display indicating a failure of said internal test if said responsiveness of said flame monitor to any one or all of said DC intensity, AC intensity and flicker frequency tests of said internal signal representative of said ionization current does not meet an associated predetermined criteria for passing said test.

27. The ionic flame monitor of claim 1 wherein said computing device has an input/output for connection to a remote computing device to provide information about said flame monitor to said remote computing device and to receive information from said remote computing device.

28. The ionic flame monitor of claim 27 wherein said input/output for connection to a remote computing device is selected between one or more interfaces for transmitting information between said flame monitor computing device and said external computing device.

29. The ionic flame monitor of claim 28 wherein one or more interfaces are a first interface that meets the RS-232 transmission standard and a second interface that meets the RS-485 transmission standard.

30. The ionic flame monitor of claim 1 wherein said computing means monitors the integrity of said flame monitor by monitoring one or more parameters internal to said flame monitor when said flame monitor is determining the existence of said flame.

31. The ionic flame monitor of claim 30 wherein said integrity monitoring occurs a predetermined number of times per second.

* * * * *